US005164045A

United States Patent [19]

Awofeso et al.

[11] Patent Number: 5,164,045

[45] Date of Patent: Nov. 17, 1992

[54] SOFT, HIGH BULK FOAM-FORMED STRATIFIED TISSUE AND METHOD FOR MAKING SAME

[75] Inventors: Anthony O. Awofeso, Appleton; Frank D. Harper, Neenah, both of Wis.

[73] Assignee: James River Corporation of Virginia, Richmond, Va.

[21] Appl. No.: 664,340

[22] Filed: Mar. 4, 1991

[51] Int. Cl.[5] ..... D21H 11/00

[52] U.S. Cl. ..... 162/101; 162/111; 162/112; 162/129; 162/130; 162/149

[58] Field of Search ..... 162/9, 123, 129, 130, 162/149, 101, 111, 112

[56] References Cited

U.S. PATENT DOCUMENTS 3,434,918 3/1969 Bernardin .
3,994,771 11/1976 Morgan, Jr. et al. .
4,100,017 7/1978 Flautt, Jr. .
4,225,382 9/1980 Kearney et al. .
4,464,224 8/1984 Matolcsy .
4,781,793 11/1988 Halme .
4,795,530 1/1989 Soerens et al. .

*Primary Examiner*—Peter Chin

[57] ABSTRACT

A foam-formed nonlaminated stratified paper tissue includes a first layer of bulky anfractuous fiber blend and a second layer of fiber blend having enhanced softness and caliper as compared to a conventional tissue of equivalent basis weight and strength. In a preferred embodiment, the first layer is a fiber blend of a bulky anfractuous fiber and a chemithermomechanical pulp. A method of forming a foam-formed nonlaminated stratified web of paper tissue material includes supplying a first furnish of a bulky anfractuous fiber blend directly to a foraminous support member. A second furnish of fiber blend is supplied onto the first furnish disposed on the foraminous support member. The furnishes may also be supplied in reverse order depending upon the forming configuration of the machine used. The first and second furnishes form a web of paper tissue material which is dried in a drying device to a predetermined dryness.

17 Claims, 6 Drawing Sheets

SOFT, HIGH BULK FOAM-FORMED STRATIFIED TISSUE AND METHOD FOR MAKING SAME

BACKGROUND OF THE INVENTION

1. Field of the Invention

A foam-formed nonlaminated stratified paper tissue includes a first layer of foam-formed bulky anfractuous fiber blend and unitary therewith a second layer of foam-formed fiber blend. The first and second layers form a lower density tissue having high bulk with enhanced softness as compared to a tissue of equal strength and basis weight not having a layer of bulky anfractuous fiber blend.

2. Description of the Background Art

Hithertofore, paper tissues have been constructed of fiber blend material. Normally, the tissues are through-air-dried in order to provide a tissue having a low density with both high bulk and high softness.

Through-air-drying is an expensive process which adds to the cost of manufacturing the tissue. An absorbent paper tissue having blended fibers which includes a first layer of foam-formed bulky anfractuous fiber blend together with a second layer of foam-formed fiber blend formed unitary with the first layer for producing a nonlaminated stratified paper tissue having a lower density with high bulk which enhances both softness and caliper of the paper tissue as compared to a tissue of equal strength not having a layer of bulky anfractuous fiber blend has not hithertofore been developed.

SUMMARY OF THE INVENTION

The present invention provides a paper tissue with an improved structure for providing a lower density tissue with high bulk and softness. A first layer of foam-formed bulky anfractuous fiber blend is formed simultaneously with a second layer of foam-formed fiber blend. The first and second layers form a lower density tissue with high bulk and softness while enhancing the absorbency of the paper tissue as compared to a tissue of equal strength not having a layer of bulky anfractuous fiber blend.

BRIEF SUMMARY OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
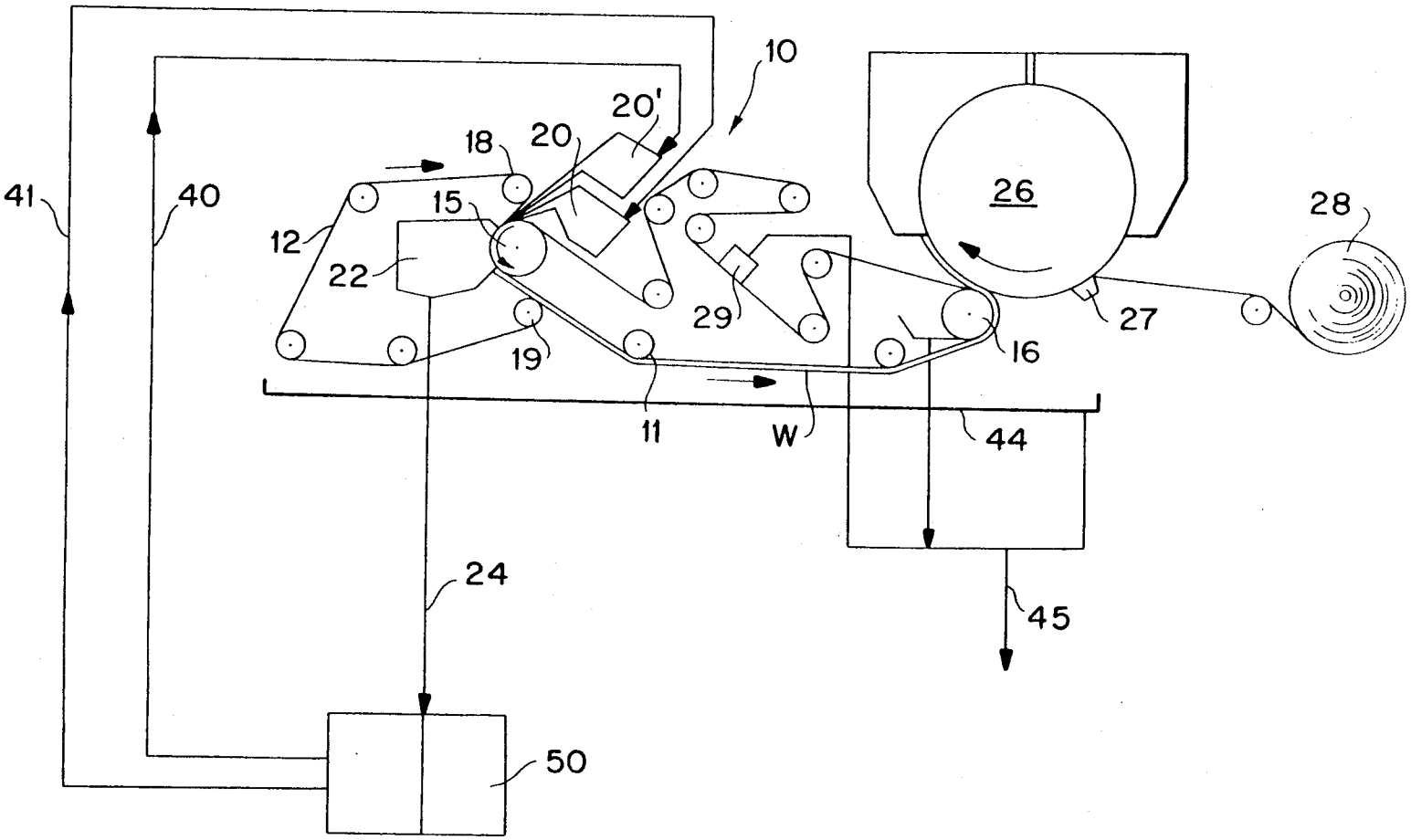
FIG. 1 is a schematic view illustrating two furnishes supplied to foraminous support means for forming a paper tissue.

Products of the present invention may be manufactured on any papermaking machine of conventional forming configurations, capable of employing foam in the forming loop such as Fourdrinier, twin-wire, suction breast roll or crescent forming configurations. For convenience, the process is described with respect to a crescent forming machine 10 as illustrated in FIG. 1, which includes a web-forming end or wet end with a liquid permeable foraminous support member 11. A foraminous support member 11 may be constructed of felt, fabric or a synthetic filament woven mesh base with a very fine synthetic fiber batt attached to the mesh base. The foraminous support member 11 is supported in a conventional manner on rolls, including breast roll 15 and couch roll or pressing roll 16.

Pressing wire 12 is supported on rolls 18 and 19 which are positioned relative to the breast roll 15 for pressing the press wire 12 to converge on the foraminous support member 11 at the cylindrical breast roll 15 at an acute angle relative to the foraminous support member 11. The foraminous support member 11 and the wire 12 move in the same direction and at the same speed which is the same direction of rotation of the breast roll 15. The pressing wire 12 and the foraminous support member 11 converge at an upper surface of the forming roll 15 to form a wedge-shaped space or nip into which two jets of foamed liquid-fiber dispersion is pressed between the pressing wire 12 and the foraminous support member 11 to force fluid through the wire 12 into a saveall 22 where it is collected as foamed liquid having an air content in the range of 50 to 80 percent by volume for reuse in the process.

A wet web W formed in the process is carried by the foraminous support member 11 to the pressing roll 16 where the wet web W is transferred to the drum 26 of a yankee dryer. Fluid is pressed from the wet web W by pressing roll 16 as the web is transferred to the drum 26 of the yankee dryer where it is dried and creped by means of a creping blade 27. The finished web is collected on a take-up roll 28.

Foamed liquid collected from the foamed fiber furnish in the saveall 22 is returned through line 24 to a recycling process generally indicated by box 50. The foam and surfactant are supplied together with additional pulp through lines 41 and 40 to form the furnish supplied to headboxes 20 and 20', respectively.

A pit 44 is provided for collecting water squeezed from the furnish by the press roll 16 and a Uhle box 29. The water collected in the pit 44 may be collected into a flow line 45 for separate processing to remove surfactant and fibers from the water and to permit recycling of the water and the surfactant back to the paper making machine 10.

The foam-formed nonlaminated stratified paper tissue of the present invention may be formed on a paper making machine 10 as discussed hereinabove. A first furnish would be supplied through the pressurized headbox section 20. A second furnish would be supplied through the headbox section 20'.

As illustrated in FIG. 1, a first furnish of a bulky anfractuous fiber blend is supplied from the first headbox section 20 to the foraminous support member 11.

Simultaneously therewith, a second furnish of a fiber blend is supplied from the headbox section 20' onto the first furnish disposed on the foraminous support means 11. Some of the foam in the first and second furnishes is removed by means of the saveall 22 and returned by means of the line 24 to a surfactant recycling system 50. In addition, water and foam which is conveyed along the foraminous support means 11 is permitted to fall by means of gravity into the pit 44. Thereafter, surfactant and water will flow through the line 45 to a recycling system wherein the surfactant is removed from the water and recycled back into the foam forming process.

The foam-formed nonlaminated stratified paper web W continues along the foraminous support means 11 to the pressing roll 16. At this particular junction, water and surfactant continues to be removed from the web and is conveyed to the line 45 for recycling. The paper tissue web W engages drum 26 of a yankee dryer, the hot surface of which has been previously sprayed with adhesives in the conventional manner to dry the paper tissue to a predetermined dryness. Thereafter, a blade 27 is utilized to crepe the foam-formed nonlaminated stratified tissue off of the drum and to collect the finished paper tissue on a take-up roll 28.

Further details of processes and apparatus which are useful in the practice of the present invention may be found in the following co-pending U.S. Applications incorporated by reference herein: (i) Dwiggins and Bhat, Foam-forming Method and Apparatus, Ser. No. 07/599,149, filed Oct. 17, 1990; (ii) Janda, High Purity Stratified Tissue and Method of Making Same, Ser. No. 07/641,657, filed Jan. 15, 1991; (iii) Ahrens, Control of Headbox for Aqueous and Foamed Furnishes, Ser. No. 7/607,509, Filed Nov. 1, 1990; (iv) Baran, et al, Pumps and Pumping Method, Ser. No. 07/633,455, filed Dec. 15, 1990; and (v) Kershaw, et al, High Softness Embossed Tissue, Ser. No. 07/641,656 filed Jan. 15, 1991.

The foam-formed nonlaminated stratified paper tissue according to the present invention produces a high bulk tissue with low density. The paper tissue has improved bulk and softness at a given strength as compared to conventional paper tissue.

The foam-formed nonlaminated stratified paper tissue of the present invention includes a first layer of foam-formed bulky anfractuous fiber blend. A second layer of foam-formed fiber blend is formed unitary therewith. The first and second layers form a low density tissue with high bulk which has an enhanced softness as compared to a tissue of equal weight and strength not having a layer of bulky anfractuous fiber blend. In a preferred embodiment of the present invention, the first layer is a fiber blend having a bulky anfractuous fiber and a chemithermomechanical pulp.

The paper tissue according to the present invention may be constructed to have the first layer in the range of 35–65% of the total weight of the paper tissue and the second layer in the range of 65–35% of the total weight of the paper tissue. In a preferred embodiment of the present invention, the first layer may contain approximately 65% of the total weight of the paper tissue and the second layer may contain approximately 35% of the total weight of the paper tissue.

The bulky anfractuous fiber may be a citric acid bulked fiber or any other similar crosslinked modified anfractuous fiber such as described in U.S. patent application 07/473,404. The chemithermomechanical pulp may be Temcell 525/80 CTMP produced by Tembec, Inc. The percentages of fibers utilized in constructing a paper tissue according to a preferred embodiment of the present invention comprises a first layer having approximately 23% bulky anfractuous fiber fibers (HBA), 38.5% chemithermomechanical pulp (CTMP) and 38.5% Northern softwood kraft (NSWK). The second layer is 100% Aracruz eucalyptus. This composite structure is identified as N-3 and is set forth in the graphs illustrated in FIGS. 2–5.

The composite paper tissue structure of the present invention may have a first layer wherein the HBA may be in the range of 5–30%, the CTMP may be in the range of 10–40%, and the NSWK may be in the range of 20–80%.

In order to compare the improved combination of strength, thickness and softness of the paper tissue constructed according to the preferred embodiment and identified as N-3, two additional tissues were utilized as a basis for comparison.

A control tissue identified as N-1 was formed having a first layer of 100% Northern softwood kraft (NSWK) and a second layer of 100% Aracruz eucalyptus. The first layer formed 65% of the total weight of the tissue. The second layer formed 35% of the total weight of the tissue.

In addition, another control tissue identified as N-2 was constructed wherein the first layer included 15% bulky anfractuous fiber (HBA) and 85% Northern softwood kraft (NSWK) (Marathon). The second layer consisted of 100% Aracruz eucalyptus. The comparison tissues N-1 and N-2 are set forth in the Tables illustrated in FIGS. 2–5.

Figure 2:
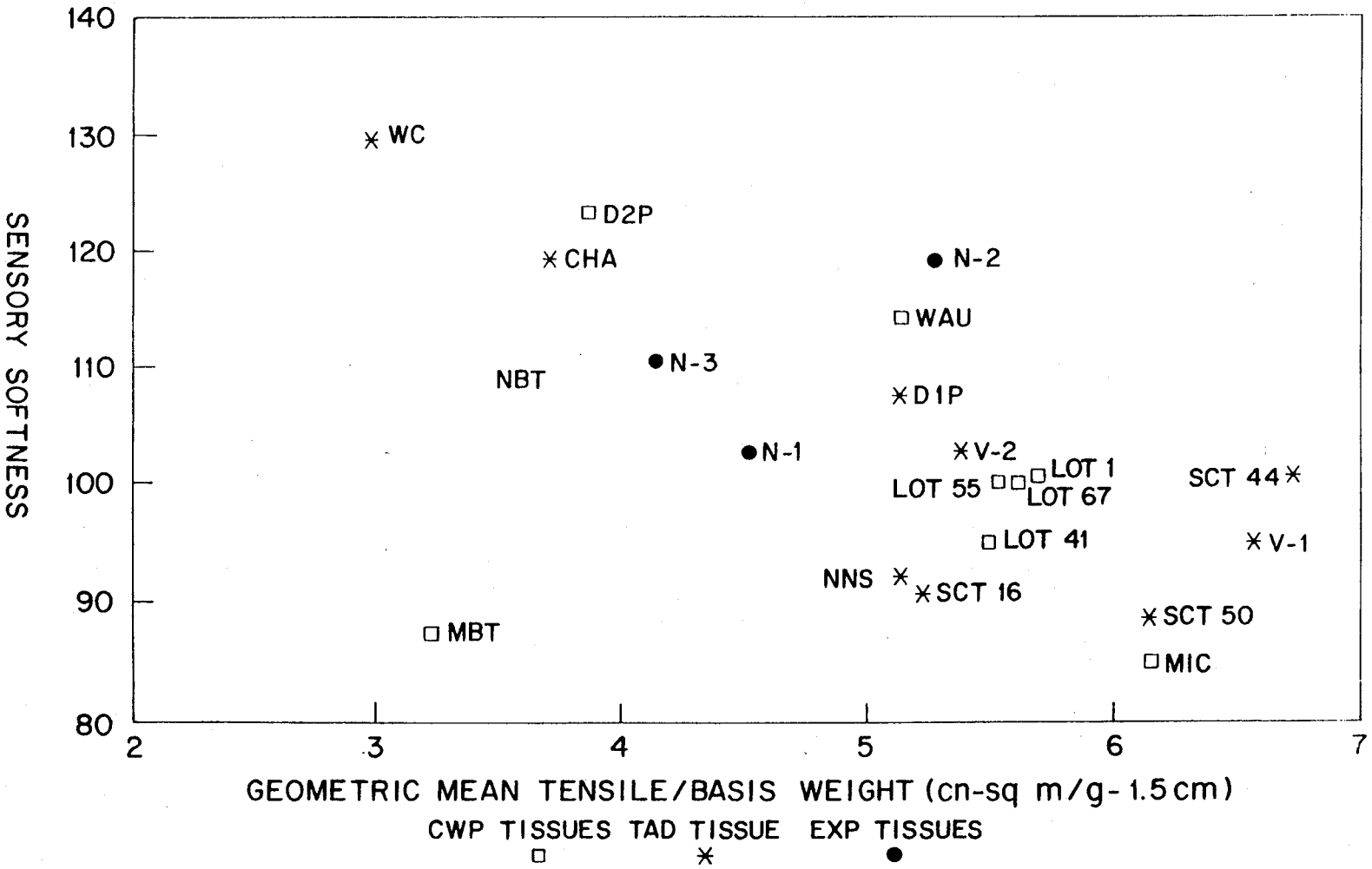
FIG. 2 illustrates data showing the sensory softness versus geometric mean tensile divided by basis weight (GMT)/(BW)

As illustrated in FIG. 2, the sensory softness is compared to the geometric mean tensile (GMT)/basis weight (BW). In the preferred embodiment of the present invention N-3 has a sensory softness of approximately 110 and a GMT/BW of approximately 4.1. The control tissue N-1 has a sensory softness of approximately of 102 and a GMT/BW of approximately 4.5. The control tissue N-2 has a sensory softness of approximately 119 and a GMT/BW of approximately 5.3, but lacks the desirable bulk of the tissue of the present invention N-3.

The additional tissues identified in FIG. 2 represent paper tissues manufactured by the assignee of the present invention or by other companies. The following will provide a Code Key for the paper tissues identified in FIG. 2, along with the process which we hypothesize was used for production thereof based upon examination of the tissues.

CODE KEY

| Ply | Code | Process Utilized |
|---|---|---|
| 2-Ply | WC | TAD |
| 2-Ply | MBT | CWP |
| 2-Ply | NBT | CWP |
| 1-Ply | CHA | TAD |
| 2-Ply | D2P | CWP |
| 1-Ply | NNS | TAD |
| 2-Ply | WAU | CWP |
| 1-Ply | D1P | TAD |
| 2-Ply | Lot 41 | CWP |
| 2-Ply | Lot 55 | CWP |
| 2-Ply | Lot 67 | CWP |
| 2-Ply | Lot 1 | CWP |
| 1-Ply | SCT 16 | TAD |
| 1-Ply | SCT 44 | TAD |
| 1-Ply | SCT 50 | TAD |
| 1-Ply | V-1 | TAD |
| 2-Ply | MIC | CWP |

-continued

CODE KEY

| Ply | Code | Process Utilized |
|---|---|---|
| 1-Ply | V-2 | TAD |
| 2-Ply | N-1 | CWP |
| 2-Ply | N-2 | CWP |
| 2-Ply | N-3 | CWP |

In the heading entitled "Processed Utilized," the acronyms "CWP" stands for "Conventional Wet Pressed" and "TAD" stands for "Through-Air-Drying."

The small squares illustrated in FIG. 2 represent conventional wet pressed bathroom tissue (CWP), the circles represent experimental tissues N-1, N-2, and N-3, and the stars represent through-air-drying processing (TAD).

The through-air-dried paper tissues produce a sensory softness and a GMT/BW which is preferred by the average consumer. However, through-air-drying is a very expensive process for manufacturing paper tissue of similar grammage and strength. As illustrated in FIG. 2, the foam-formed nonlaminated stratified paper tissue N-3 has a sensory softness and a GMT/BW which is comparable to the through-air-dried tissues while possessing exceptionally high bulk.

The through-air-drying process requires hot air, which is expensive, and requires more time, thus making the process slower. This process is not very efficient. However, through-air-dried does provide a relatively bulky product.

The foam-formed nonlaminated stratified paper tissue according to the present invention permits the construction of a product which has similar characteristics to paper made via the through-air-dried process. However, the process of the present invention is faster and permits better drainage of the product. The step of non-compactive through-air-drying may be eliminated in the process of the present invention wherein the foam-formed web is supplied directly to the yankee drier from the foraminous support means 11, thereby making it possible to increase machine speed.

Figure 3:
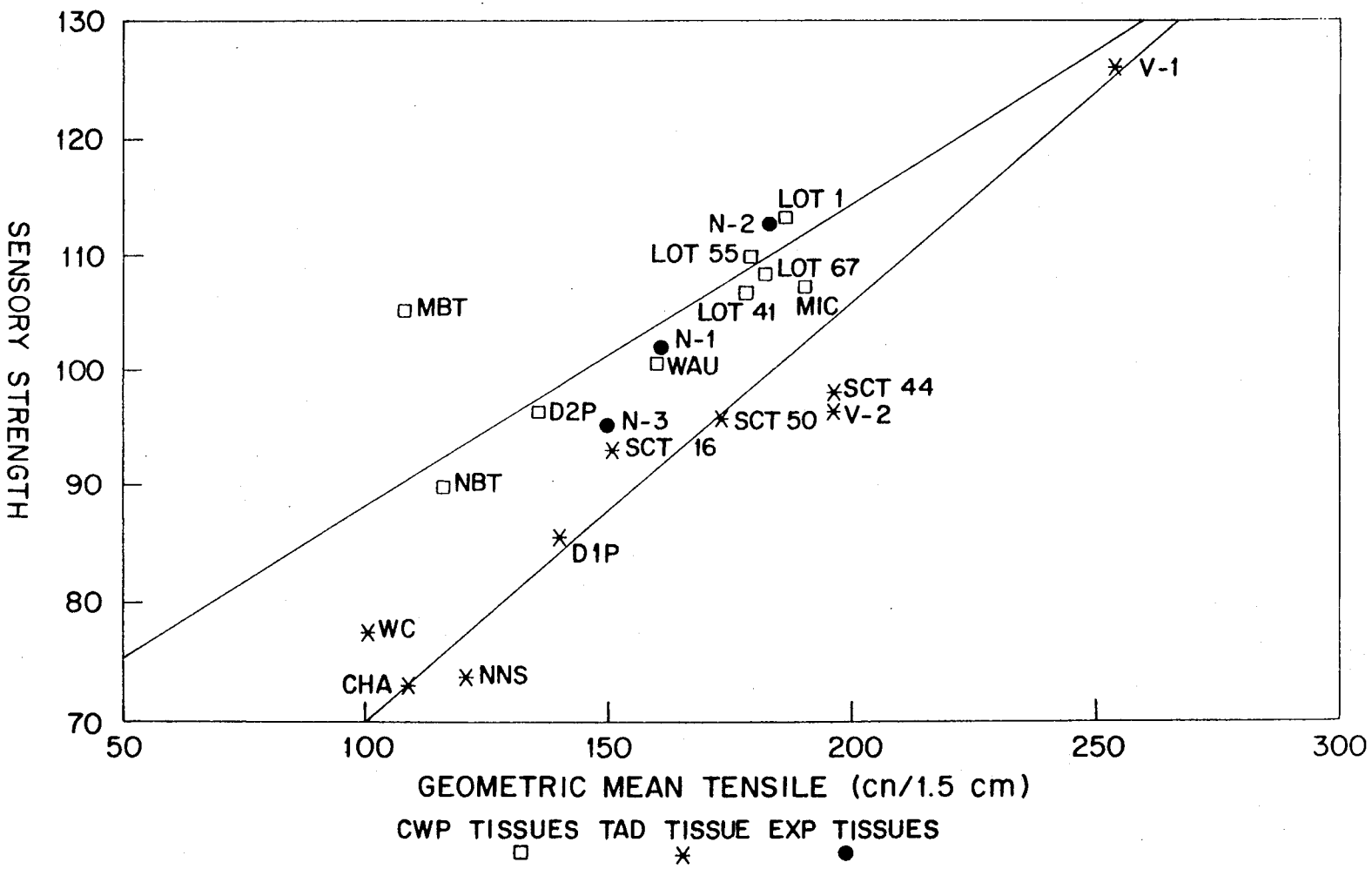
FIG. 3 illustrates data showing the sensory strength versus geometric mean tensile (GMT)

FIG. 3 illustrates the sensory strength as compared to the geometric mean tensile (GMT). The tissue samples were evaluated for overall softness, sensory bulk, and sensory strength. Each of the tissue samples were evaluated using the paired comparison methodology, where a direct comparison is made to evaluate all products for each property tested. The results of each comparison were transformed from raw comparative data into scaler values via the Thurstone algorithm.

Ten panelists completed two iterations of each comparison. The panelists evaluated softness, bulk, and strength by manipulating tissue in their hands. Each property was addressed separately using a comparative recording scheme. The recording format used for softness is shown below. A comparable format was used for strength.

| |
|---|
| No real comparison - the sample is much softer. |
| I am sure the sample is softer. |
| I think there may be a difference in softness, and the sample is probably softer. |
| I AM POSITIVE/ALMOST POSITIVE THERE IS NO REAL DIFFERENCE IN SOFTNESS. |

-continued

| |
|---|
| I think there may be a difference in softness, and the sample is probably less soft. |
| I am sure the sample is less soft. |
| No real comparison - the sample is much less soft. |

The acronyms set forth in FIG. 3 are identified in the Code Key hereinabove.

In the preferred embodiment of the present invention, N-3 has a sensory strength of approximately 96 and a GMT of approximately 150. This sensory strength and GMT is within the acceptable range identified by the two lines set forth in FIG. 3. The range is comparable to the sensory strength and GMT of the SCT 16, 44 and 50 1-Ply products.

Figure 4:
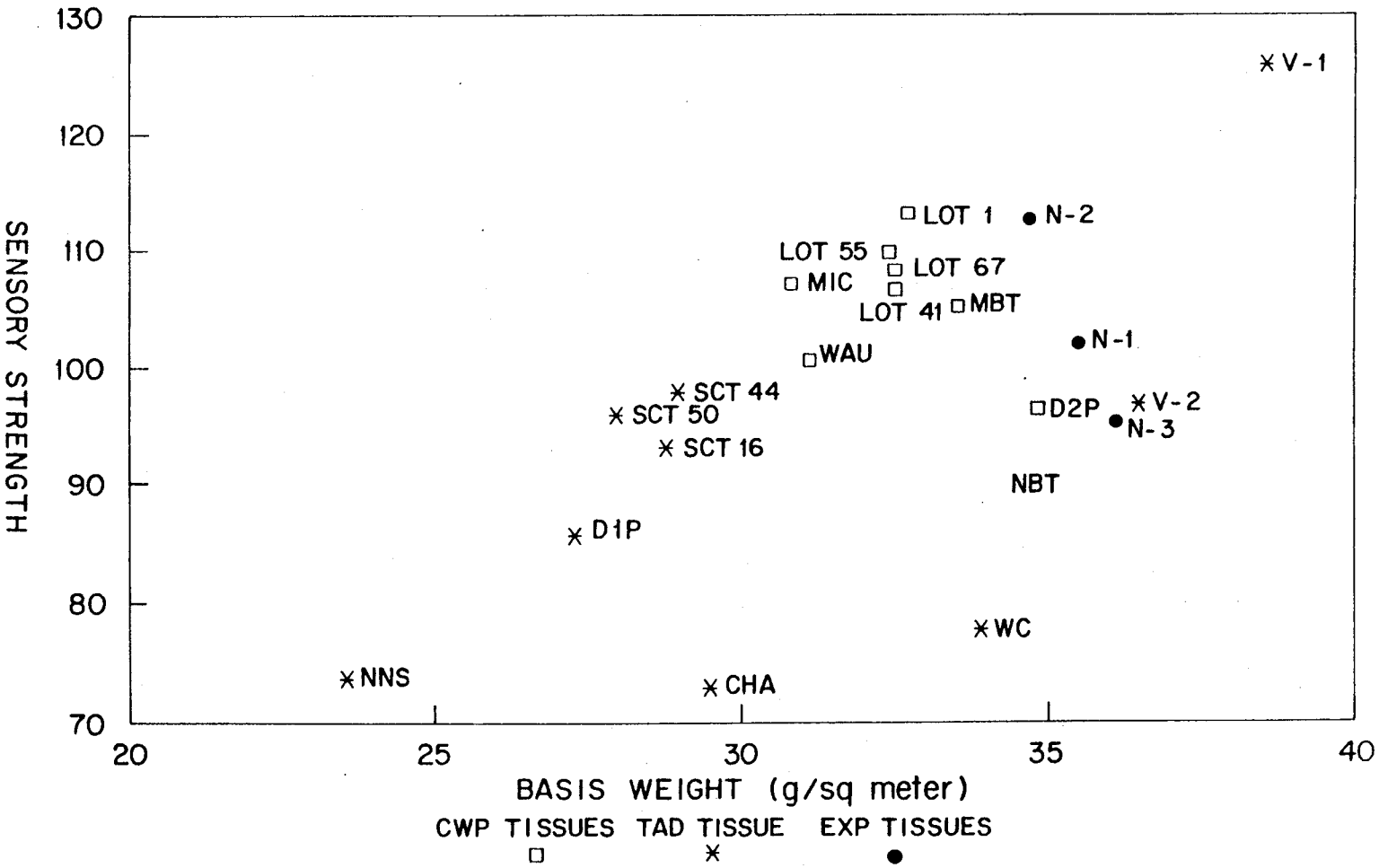
FIG. 4 illustrates data showing sensory strength versus basis weight (BW)

FIG. 4 illustrates the sensory strength, as compared to the basis weight (BW). In the preferred embodiment of the present invention, N-3 provides a sensory strength of approximately 96 and a basis weight of approximately 36 grams/square meter. The control tissue N-1 has a sensory strength of approximately 101 and a basis weight of approximately 35.5 grams/square meter. The control tissue N-2 has a sensory strength of approximately 112 and a basis weight of approximately 34.7 grams/square meter. The sensory strength and basis weight of the preferred embodiment of the present invention N-3 is comparable to the V-2 which is believed to be manufactured by a through-air-dried process. The sensory strength is higher than the samples WC, CHA and the NNS, which are in the range of 72 to 80 sensory strength as compared to the present invention.

Figure 5:
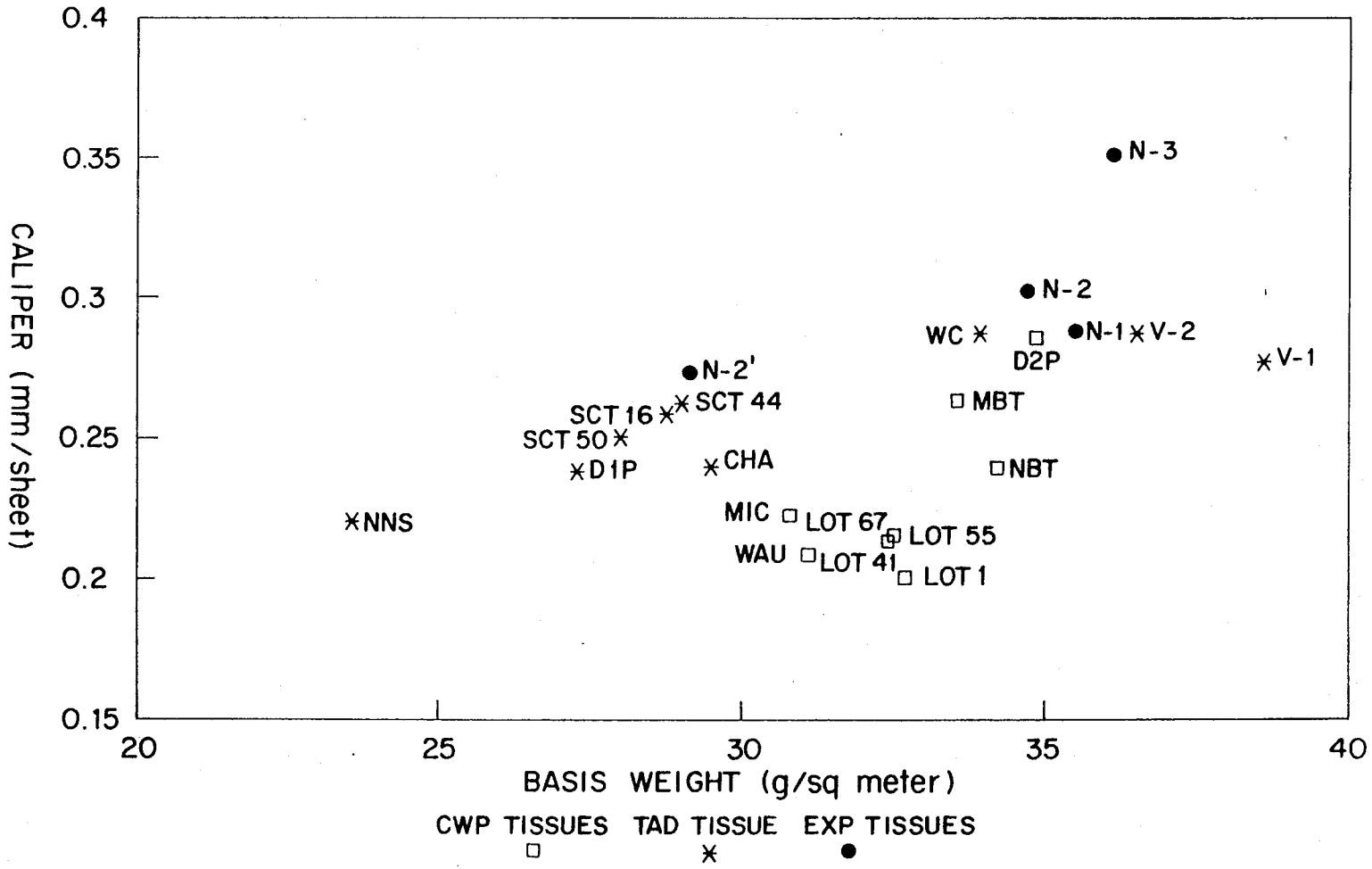
FIG. 5 illustrates data showing caliper versus basis weight.

FIG. 5 illustrates the caliper as compared to the basis weight. The sample of paper tissue N-3 according to the present invention had a caliper of approximately 0.351 mm/sheet and a basis weight of approximately 36.1 grams/square meter. The control paper tissue N-1 had a caliper of approximately 0.288 mm/sheet and a basis weight of approximately 35.5 grams/square meter. The tissue N-2 had a caliper of approximately 0.302 mm/sheet and a basis weight of approximately 34.7 grams/square meter. A second control tissue N-2', which also contains 15% HBA as in control N-2, was compared in the Table of FIG. 5 wherein the basis weight was reduced by forming the paper tissue with less fiber. In this particular example, the N-2' paper tissue has a caliper of approximately 0.295 mm/sheet and a basis weight of approximately 28.5 grams/square meter. As can be observed from FIG. 5, the paper tissue according to the present invention N-3 has a higher caliper than the comparative paper tissues made with either the through-air-drying process, or the conventional wet press process. It is considered surprising that we are able to obtain such a high caliper with the basis weight shown indicating that the present invention utilizes fiber in an extremely effective manner.

Figure 6:
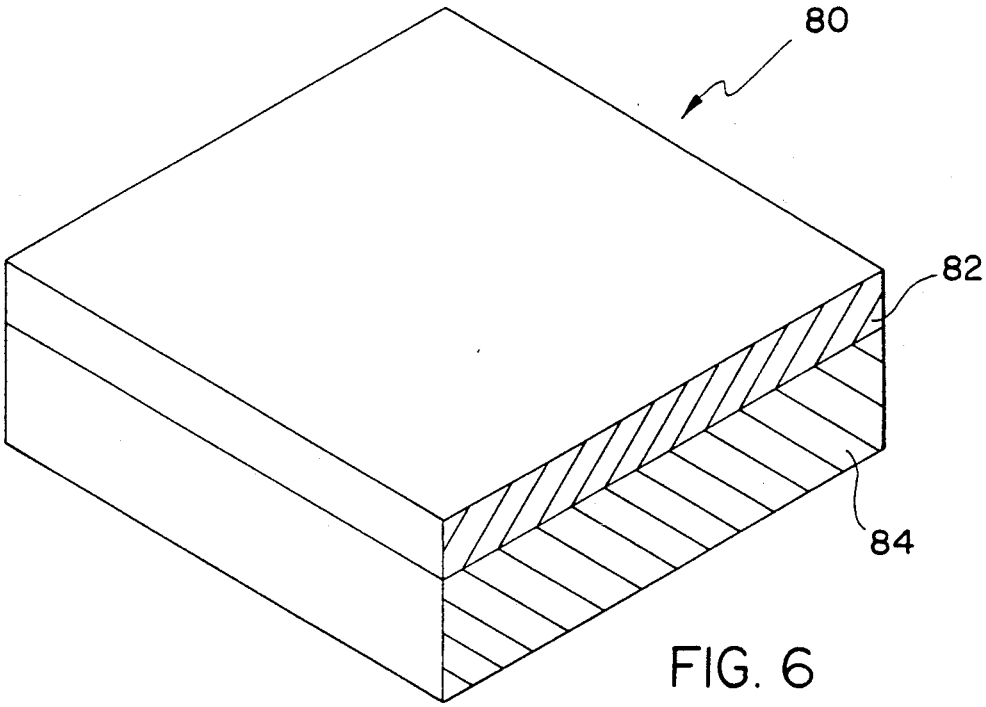
FIG. 6 is a perspective enlarged schematic illustration of the chemithermomechanical pulp and high bulk fiber composite stratified structure of the present invention.

FIG. 6 illustrates an embodiment of the present invention wherein a paper tissue 80 is formed to include a first layer of foam-formed bulky anfractuous fiber having bulky anfractuous fiber and chemithermomechanical pulp 84 and a second layer of foam-formed fiber blend 82. This composite structure is a foam-formed nonlaminated stratified paper tissue which has a lower density with high bulk while enhancing the absorption the paper tissue 80 as compared to a tissue of equal strength not having a layer of bulky anfractuous fiber blend.

Figure 7:
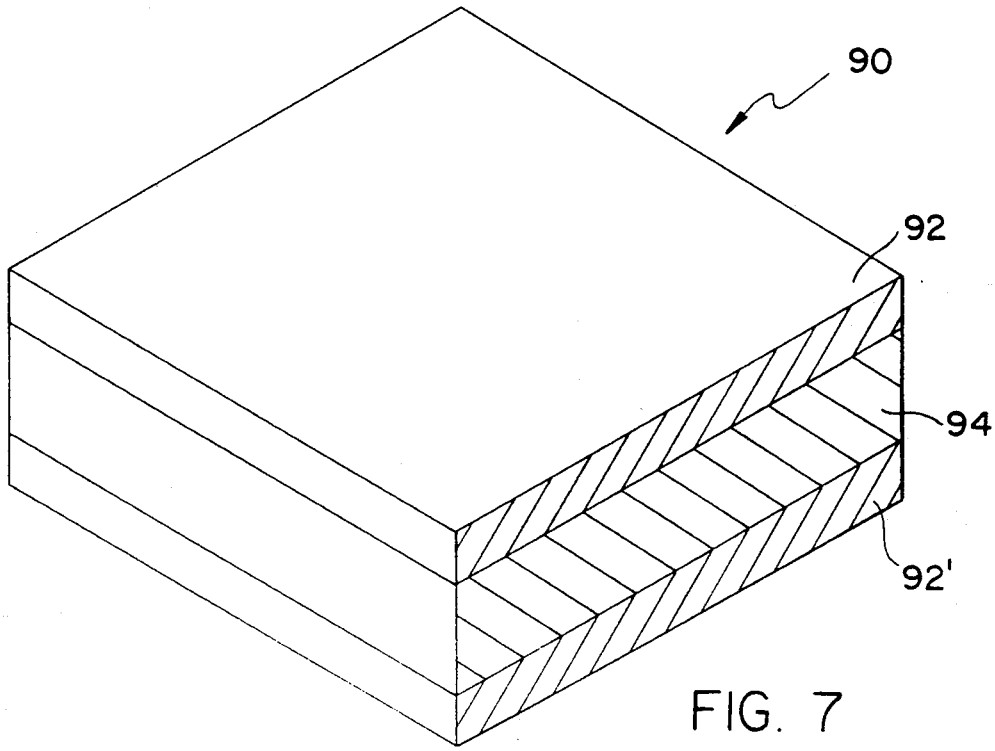
FIG. 7 is a perspective enlarged schematic illustration of a stratified structure of a paper tissue according to the present invention which includes three layers.

In another embodiment of the present invention, as illustrated in FIG. 7, a paper tissue 90 includes a first layer of foam-formed bulky anfractuous fiber blend having a bulky anfractuous fiber and a chemithermomechanical pulp 94 formed between a second layer of foam-formed fiber blend 92 and third layer of foam-formed fiber blend 92'.

In the embodiment illustrated in FIG. 7, the paper tissue 90 has a lower density with a high bulk while enhancing the absorption as compared to a tissue of equal strength not having a layer of bulky anfractuous fiber blend.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A foam-formed nonlaminated stratified paper tissue comprising:

a first layer of foam-formed bulky anfractuous cellulosic fiber blend; and a second layer of foam-formed cellulosic fiber blend formed unitary with said first layer;

said first layer being approximately 65% of the total weight of the paper tissue and includes approximately 38.5% soft wood kraft, approximately 38.5% chemithermomechanical pulp and approximately 23% bulky anfractuous fiber based on the weight of the layer and the second layer is approximately 35% of the total weight of the paper tissue;

wherein said first layer and said second layer form a lower density tissue with high bulk with enhanced softness and bulk as compared to a tissue of equal strength and basis weight not having a layer of bulky anfractuous fiber blend.

2. The foam-formed nonlaminated stratified paper tissue according to claim 1, wherein said bulky anfractuous fiber is a critic acid bulked fiber.

3. The foam-formed nonlaminated stratified paper tissue according to claim 1, wherein the second layer includes approximately 100% eucalyptus.

4. The foam-formed nonlaminated stratified paper tissue according to claim 1, and further including a third layer of cellulosic fiber blend wherein said first layer is disposed between said second and third layers.

5. The foam-formed nonlaminated stratified paper tissue according to claim 4, wherein the second and third layers includes approximately 100% eucalyptus.

6. The foam-formed nonlaminated stratified paper tissue according to claim 5, wherein the bulky anfractuous fiber is a citric acid bulked cellulosic fiber.

7. A method of forming a foam-formed nonlaminated stratified web of paper tissue material comprising:

supplying a first furnish consisting essentially of a bulk anfractuous cellulosic fiber blend in foam directly onto a foraminous support means for forming a first layer;

supplying a second furnish of cellulosic fiber blend in foam onto the first furnish disposed on the foraminous support means;

drying the first and second furnishes to form a web of foam-formed paper tissue having a predetermined dryness; and creping the paper tissue material off of a drying means;

said first layer is approximately 65% of the total weight of the web of paper tissue and includes approximately 38.5% soft wood kraft, approximately 38.5% chemithermomechanical pulp and approximately 23% bulky anfractuous fiber based on the weight of the layer and the second layer is apprxoimately 35% of the total weight of the web of paper tissue;

wherein the web of foam-formed paper tissue has a higher caliper with enhanced softness as compared to a tissue of equal strength and basis weight not having layer of bulky anfractuous fiber blend.

8. The method of forming a foam-formed nonlaminated stratified web of paper tissue material according to claim 7, wherein said bulky anfractuous fiber is a critic acid bulked fiber.

9. The method of forming a foam-formed nonlaminated stratified web of paper tissue material according to claim 7, wherein the second furnish includes approximately 100% eucalyptus.

10. The product made according to the method of claim 7.

11. A method of forming a foam-formed nonlaminated stratified web of paper tissue material comprising:

supplying a first furnish of cellulosic fiber blend in foam directly onto a foraminous support means for forming a first layer;

supplying a second furnish consisting essentially of a bulky anfractuous cellulosic fiber blend onto the first furnish disposed on the foraminous support means;

drying the first and second furnishes to form a web of foam-formed paper tissue material having a predetermined dryness and creping the paper tissue off of a drying means;

said first layer is approximately 35% of the total weight of the web of paper tissue and the second layer is approximately 65% of the total weight of the web of paper tissue, said second furnish includes approximately 38.5% soft wood kraft, approximately 38.5% chemithermomechanical pulp and approximately 23% bulk anfractuous fiber by weight of the layer;

wherein the web of foam-formed paper tissue has a higher caliper with enhanced softness as compared to a tissue of equal strength and basis weight not having a layer of bulky anfractuous fiber blend.

12. The method of forming a foam formed nonlaminated stratified web of paper tissue material according to claim 11, wherein said bulky anfractuous fiber is a citric acid bulked fiber.

13. The method of forming a foam-formed nonlaminated stratified web of paper tissue material according to claim 11, wherein the first furnish includes approximately 100% eucalyptus.

14. The product made according to the method of claim 11.

15. A foam-formed nonlaminated stratified paper tissue comprising:

a first layer of foam-formed bulk anfractuous cellulosic fiber blend;

a second layer of foam-formed cellulosic fiber blend formed unitary with said first layer; and a third layer of cellulosic fiber blend wherein said first layer is disposed between said second and third layers;

said second and third layers include approximately 100% eucalyptus;

said first layer includes approximately 38.5% soft wood kraft, approximately 38.5% chemithermomechanical pulp and approximately 23% bulky anfractuous fiber based on the weight of the layer;

wherein said first layer, said second layer and third layer form a lower density tissue with high bulk with enhanced softness and bulk as compared to a tissue of equal strength and basis weight not having a layer of bulky anfractuous fiber blend.

16. The foam-formed nonlaminated stratified paper tissue according to claim 15, wherein the bulk anfractuous fiber is a citric acid bulked cellulosic fiber.

17. The foam-formed nonlaminated stratified paper tissue according to claim 15, wherein said bulky anfractuous fiber is a citric acid bulked fiber.

* * * * *